US007063561B2

(12) United States Patent
Pabst

(10) Patent No.: US 7,063,561 B2
(45) Date of Patent: Jun. 20, 2006

(54) CLAMPING CONNECTOR FOR FLEXIBLE RIBBON CABLES

(75) Inventor: Thomas Bernhard Pabst, Röthenbach a.d. Pegnitz (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/532,476

(22) PCT Filed: Oct. 28, 2003

(86) PCT No.: PCT/EP03/11951

§ 371 (c)(1),
(2), (4) Date: Apr. 22, 2005

(87) PCT Pub. No.: WO2004/040711

PCT Pub. Date: May 13, 2004

(65) Prior Publication Data

US 2005/0266725 A1 Dec. 1, 2005

(30) Foreign Application Priority Data

Oct. 31, 2002 (DE) ..... 102 50 924

(51) Int. Cl.
*H01R 12/24* (2006.01)

(52) U.S. Cl. ..... 439/498; 439/495; 439/67

(58) Field of Classification Search ..... 439/498, 439/495, 329, 67
See application file for complete search history.

(56) References Cited

U.S. PATENT DOCUMENTS

| | | | | |
|---|---|---|---|---|
| 4,610,495 | A * | 9/1986 | Landi | 439/728 |
| 4,647,125 | A | 3/1987 | Landi et al. | 339/17 F |
| 4,828,512 | A * | 5/1989 | McCormick et al. | 439/495 |
| 4,900,264 | A | 2/1990 | Bennett et al. | 439/391 |
| 5,007,856 | A * | 4/1991 | Puerner | 439/452 |
| 5,213,511 | A * | 5/1993 | Sobhani | 439/67 |
| 5,743,747 | A * | 4/1998 | Sobhani | 439/67 |
| 6,017,244 | A * | 1/2000 | Daane | 439/495 |
| 6,074,220 | A | 6/2000 | Roberts | 439/67 |
| 6,247,951 | B1 * | 6/2001 | Di Liello et al. | 439/329 |
| 6,447,305 | B1 * | 9/2002 | Roberts | 439/67 |
| 6,780,046 | B1 * | 8/2004 | Bach et al. | 439/495 |

FOREIGN PATENT DOCUMENTS

| | | |
|---|---|---|
| DE | 691 12 455 T2 | 2/1991 |
| DE | 198 04 586 A1 | 8/1998 |
| DE | 0 971 443 A2 | 1/2000 |
| DE | 198 32 011 A1 | 2/2000 |
| DE | 100 06 112 A1 | 8/2001 |
| DE | 100 34 613 A1 | 1/2002 |
| DE | 100 65 972 A1 | 7/2002 |
| EP | 0 971 443 A3 | 1/2000 |

* cited by examiner

*Primary Examiner*—Gary F. Paumen
(74) *Attorney, Agent, or Firm*—Harrington & Smith, LLP

(57) ABSTRACT

The invention relates to a clamping connector for at least two aligned flexible ribbon cables, said connector including a base body, spring elements for pressing together the surfaces to be brought into contact, and a counter body. The base body and the counter body can be fixed to each other in a pre-locking position and a final locking position. The respective skinned partial regions of at least two flexible ribbon cables are pressed against each other in order to bring the same into contact. The sides of the base body and the counter body, facing the flexible ribbon cables, are provided with complementary recesses or projections by which means the flexible ribbon cables can be guided to form a cable grip.

18 Claims, 15 Drawing Sheets

CLAMPING CONNECTOR FOR FLEXIBLE RIBBON CABLES

FIELD OF THE INVENTION

The present invention relates to a clamp connector for flexible ribbon cables in accordance with the preamble of patent claim 1. Such a connector is known from DE 100 06 112 A1.

BACKGROUND OF THE INVENTION

DE 198 32 011 A1 describes several variants of clamp connectors in which flexible ribbon cables are stripped at the sites being connected and the stripped conductor tracks of the cables are pressed against one another by spring elements. These clamp connectors are in need of improvement in terms of their handling, because either they do not afford adequate protection against strain applied to the cable or else a strain relief necessitates costly preparations. At the site of assembly—for example, in a motor vehicle—what is of importance is a simple and secure handling during assembly. To this end, it is not expedient for a clamp connector to consist of several separate parts that have to be assembled with the ends of the flexible ribbon cables being connected.

DE 100 06 112 A1 describes a connector for flexible ribbon cables in which one stripped end of each of two flexible ribbon cables is pressed against a free, elastically spring-loaded end of a respective contact spring, so that an electrical connection is produced between the two flexible ribbon cables via the contact spring. This arrangement has the drawback that, in order to produce an electrical connection between the conductor tracks of two flexible ribbon cables, two respective contact sites are required, which, together, pose a higher risk of an increase in contact resistance due to oxidation, contamination, kink formation, or the like than is the case for a direct contacting of the two flexible ribbon cables.

SUMMARY OF THE INVENTION

The present invention is based on the problem of improving a generic clamp connector in such a way that, without great preparation of the cable, a good electrical connection with low contact resistance and a strain relief that is realized rapidly can be produced and the handling is simplified during assembly.

This problem is solved in accordance with the claims. Characterized in the subclaims are features of preferred embodiments of the invention.

The invention is based on the idea of clamping the ends of the flexible ribbon cables being connected between at least two pieces in such a way that the cable is pressed into a relief that forms "obstacles," which deform the cable in such a way that high pull-out forces are required in order to detach the cable from the connector. Furthermore, the prelocking position makes possible a simple assembly, because the cable ends have to be inserted only up to a stop in the pre-assembled connector in order to be fixed in place subsequently by pressing the connector pieces together.

BRIEF DESCRIPTION OF THE DRAWINGS

The invention will be illustrated in greater detail below on the basis of the description of embodiment examples with reference to the drawing. Shown therein is the following.

DETAILED DESCRIPTION OF THE INVENTION

Figure 1:
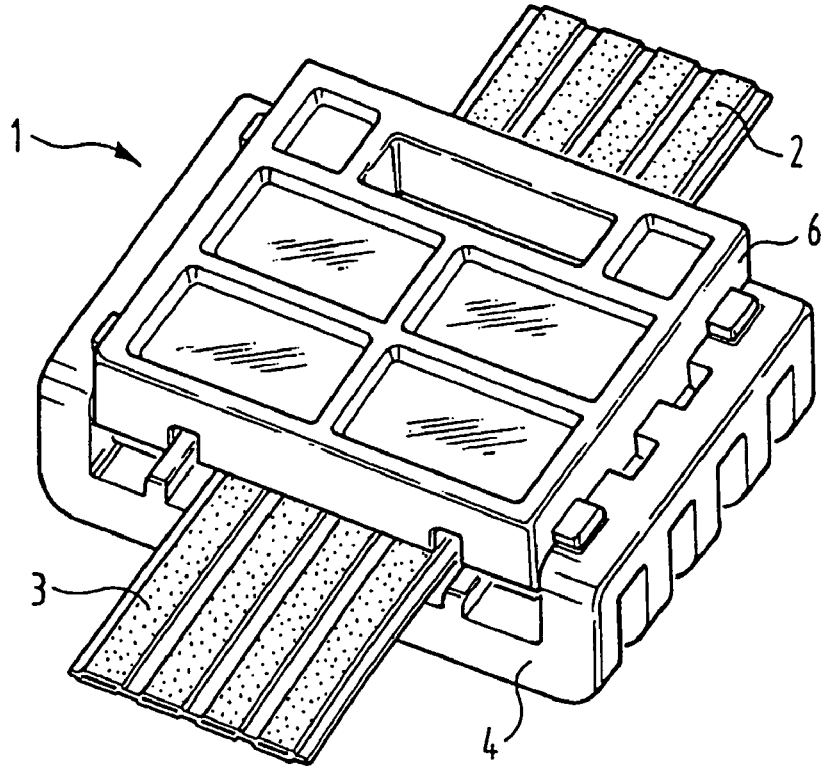
FIG. 1, a first embodiment of the clamp connector of the invention in perspective view.

FIG. 1 shows, in perspective view, a first embodiment of a clamp connector of the invention. The connector 1 has a base piece 4 and a mating piece 6. The flexible ribbon cables 2, 3 being connected each have at their ends a region in which the insulation is stripped from the conductive tracks being connected. The flexible ribbon cables 2, 3 being connected are each inserted from different sides into the clamp connector 1 and the mating piece 6, which, during this operation, is in a prelocking position in which it forms, together with the base piece 4, an adequately large slot for inserting the flexible ribbon cables 2, 3, is then brought into its final locking position by pressing together the base piece and the mating piece, whereby the connection is produced.

Figure 2:
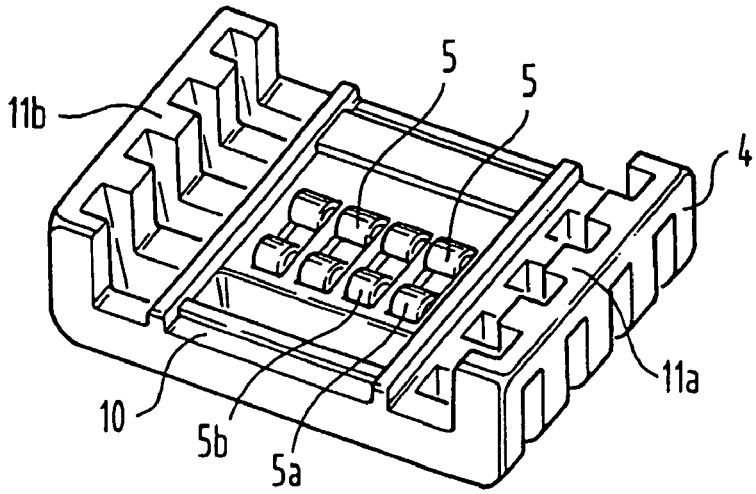
FIG. 2, the base piece of the clamp connector according to FIG. 1.
Figure 2A:
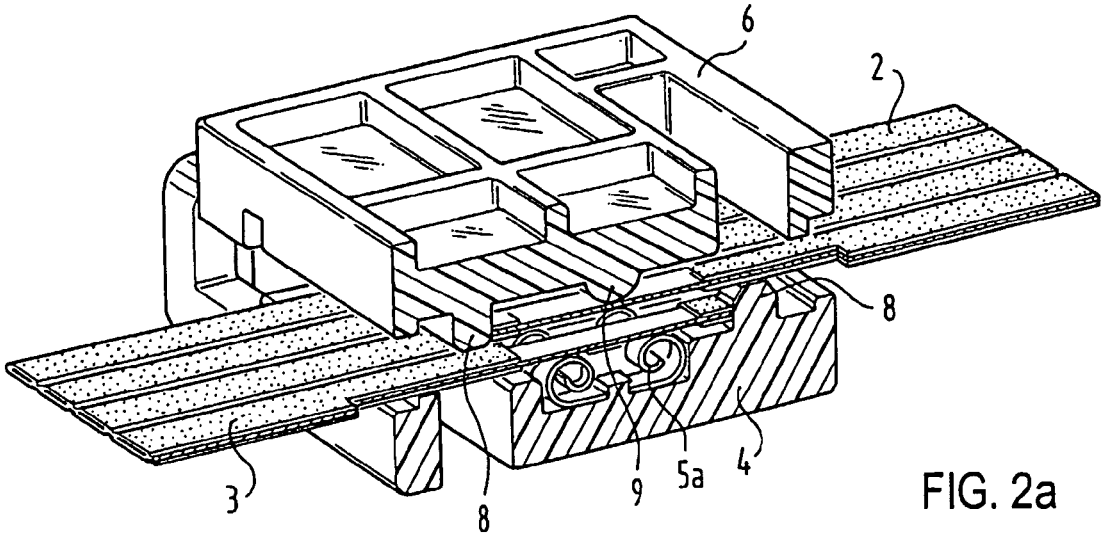
Figure 2B:
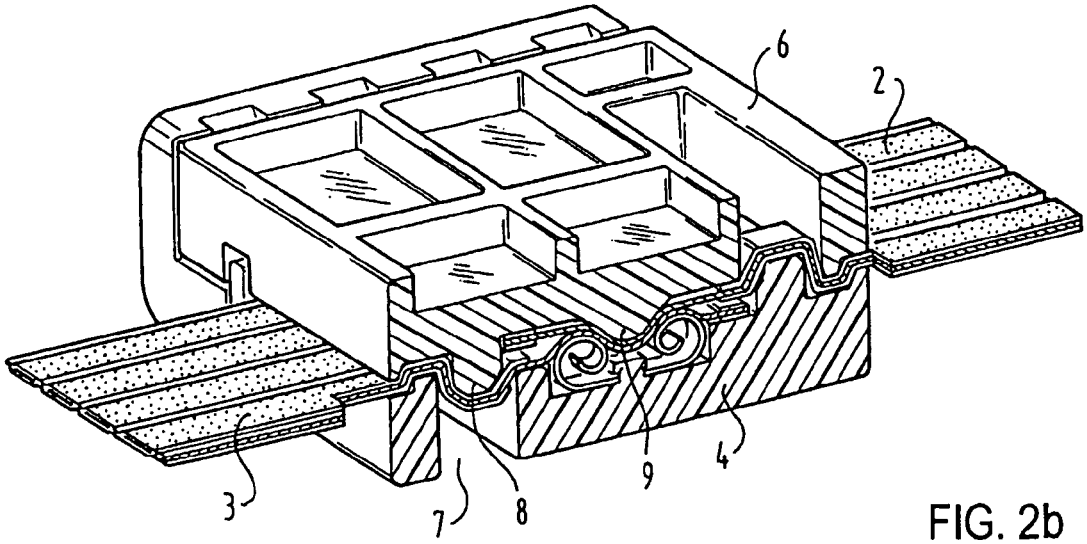

FIG. 2 shows the base piece in perspective view. The base piece 4 consists of a bottom plate 10 and side walls 11*a*, 11*b*, to which catches are affixed, with which the mating piece 6 can be held in place in a prelocking position and, finally, in the final locking position.

Arranged parallel to one another in the middle of the bottom plate 10 are four strip-shaped spring elements 5. They are calked or fixed, such as with caulk for example, in chambers provided for them in the bottom plate 10 and are mutually arranged in such a way that each of the flexible ribbon cables presses against the other at the level of the conductive track. The spring elements 5 are bent in the shape of spirals at their ends in order, in this way, to be able to exert their spring force perpendicular to the longitudinal extension of the flexible ribbon cables.

Figure 3A:
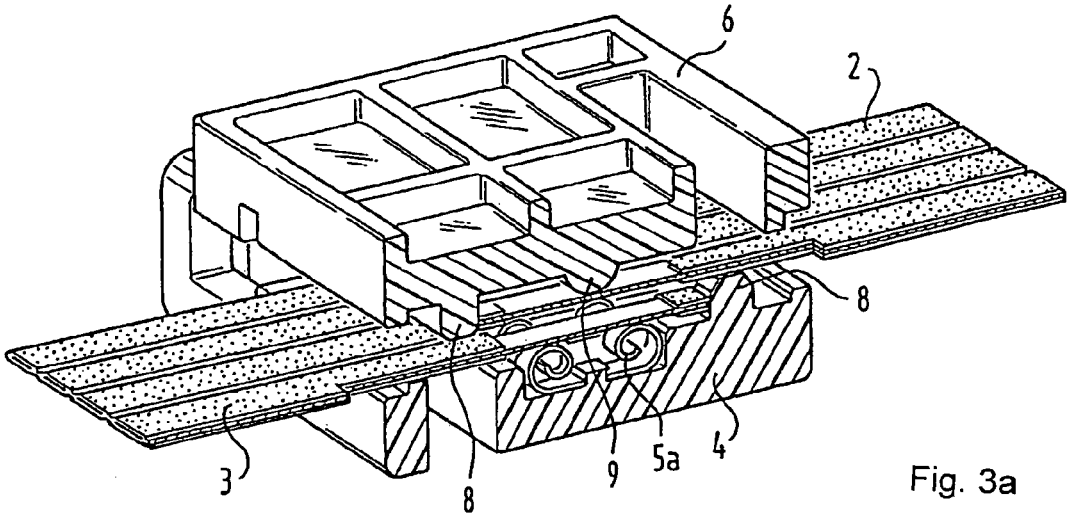
FIG. 3*a* to *c*, a section through the clamp connector according to FIG. 1 in prelocking position and in final locking position.

FIG. 3 shows the clamp connector in lengthwise section in perspective view. FIG. 3*a*[1] shows the clamp connector in prelocking position, in which the flexible ribbon cables 2, 3 can be inserted. Evident in FIG. 3*a* are two ribs 8, which are arranged transverse to the longitudinal extension of the flexible ribbon cables 2, 3 on the base piece 4 and on the mating piece 6. These serve, simultaneously with the insertion operation of the flexible ribbon cables 2, 3, as stops against which the front sides of the flexible ribbon cables abut. In this way, it is ensured that the stripped regions on the two flexible ribbon cables 2, 3 come to lie on top of each other in a defined way.

Figure 3B:
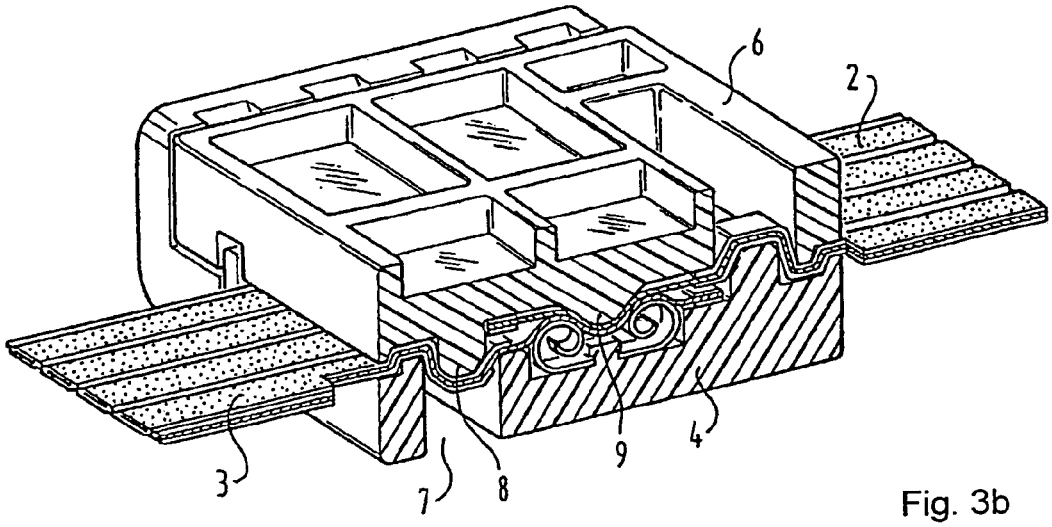
Figure 3C:
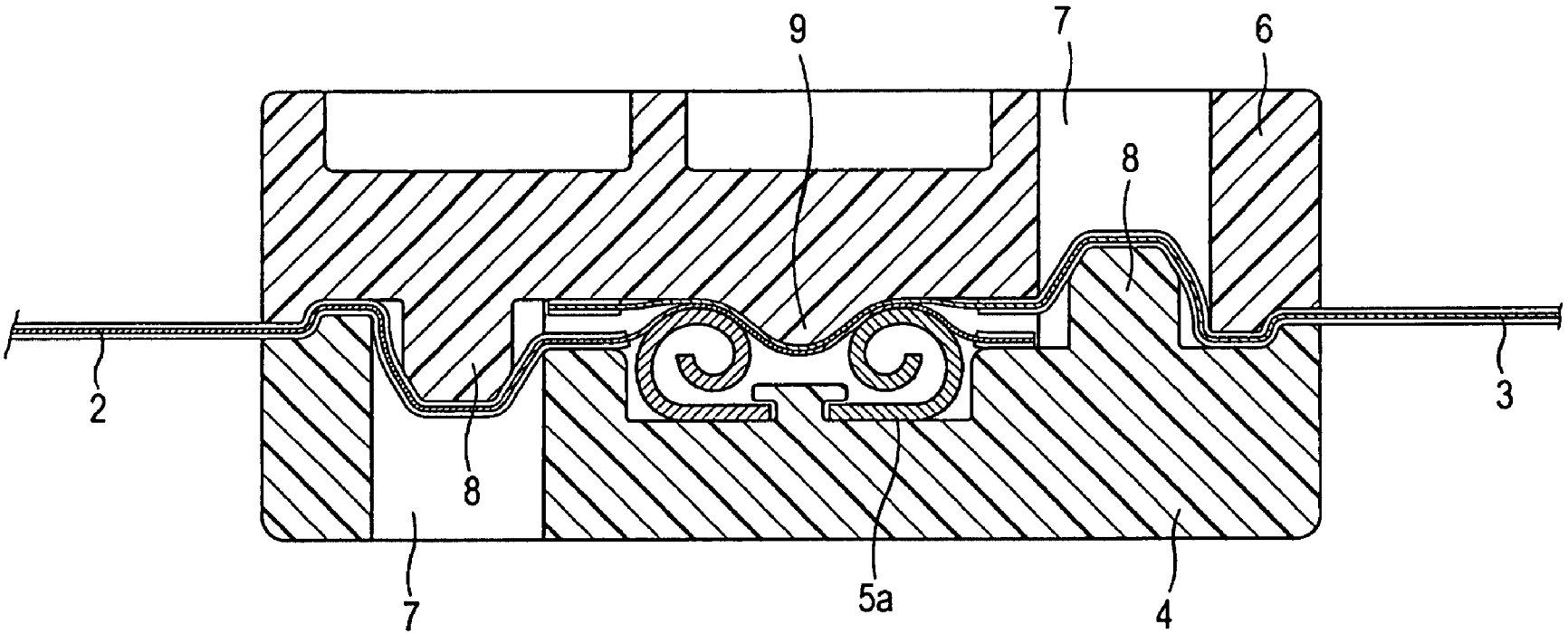

[1][Translator's Note]In the drawings, FIG. 3*a* and FIG. 3*b*.

FIG. 3*b* shows the clamp connector in the final locking position. Here, it is evident that the ribs 8 have now each pressed a flexible ribbon cable 2, 3 into a depression 7, which is constructed here as an open slot. In this way, kinks running transverse to the longitudinal extension of the flexible ribbon cables are formed in the flexible ribbon cables, owing to which a pulling of the flexible ribbon cable out of the locked connector pieces or mating pieces 4, 6 would be possible only by deformation of the cable material. Of the spring elements 5, only one (5*a*) on the outermost edge is shown, there being visible in the mating piece 6 a cross rib 9, on the side flanks of which lie the overlapping ends of the flexible ribbon cables 2, 3. This results in an enlargement of the contact surface, this being best seen in FIG. 3*c*, because, in this way, the spirally twisted ends of the spring elements 5 can apply their spring force over a larger surface onto the flexible ribbon cables.

Figure 4:
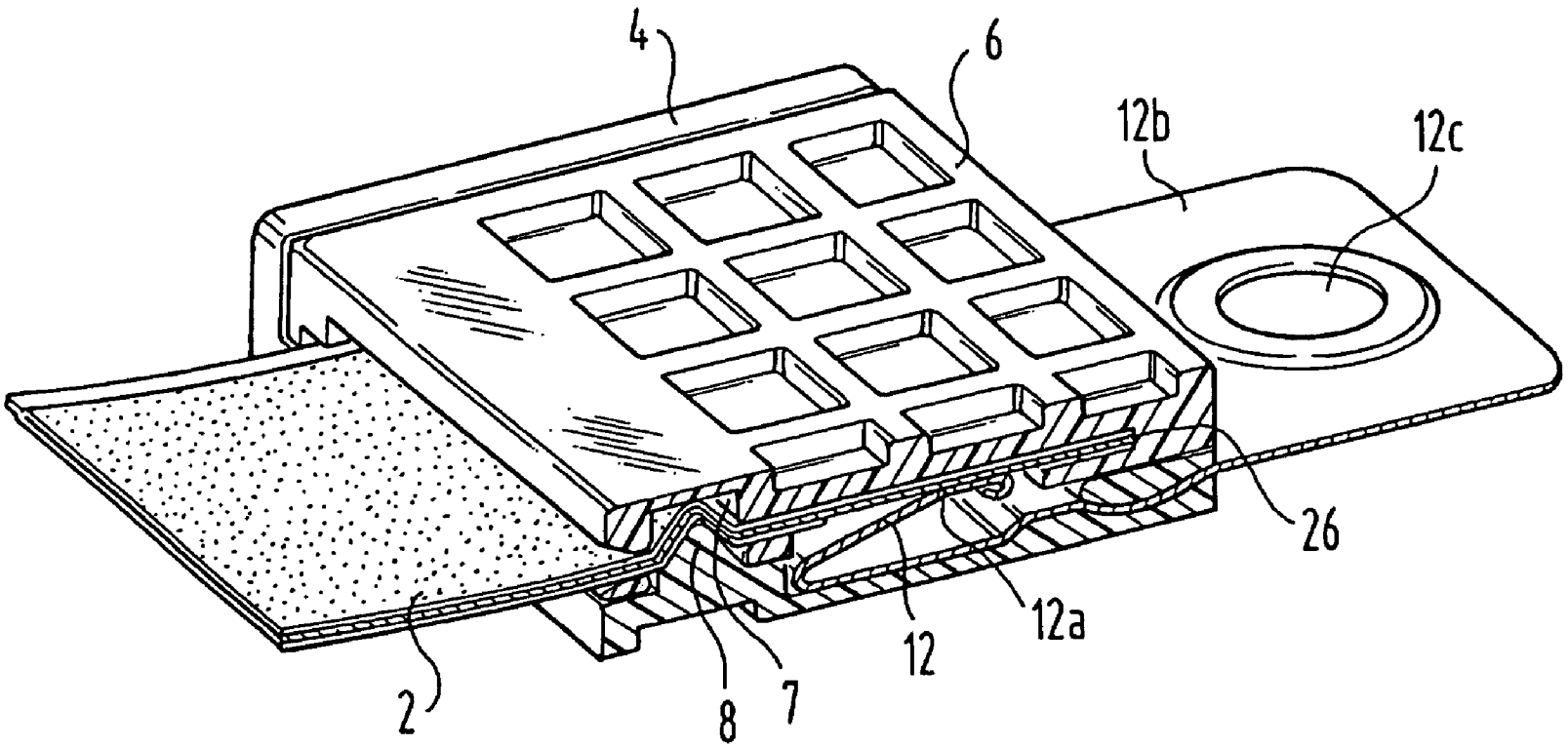
FIG. 4, a clamp connector with strain relief, which is in itself known, as ground connector.

FIG. 4 shows a clamp connector that is used as ground connector, such as is known, for example, from DE 100 06 112 A1. A contact spring 12, which extends over the entire width of the flexible ribbon cable 2, is formed in one piece with a junction end 12*b* protruding from the base piece 4. The contact spring 12 is cast in the base piece 4. The spring is formed as a U-shaped bent piece of sheet metal, the free leg of which, 12*a*, presses against the flexible ribbon cable 2 and produces an electrical contact with the connecting end 12*b* via the conductive tracks stripped of insulation. Further provided in the junction end 12*b* in its center is a screw ear 12*c*. The plug connector, just like the first embodiment, has a strain relief, which is formed here by the cross rib 8 and the corresponding depression 7 in the mating plug 6. During assembly, the flexible ribbon cable 2 is inserted into the mating piece 6 through a slot in the latter until it abuts at the opposite end against a terminal stop 26. Once the mating piece 6 has been pressed in final locking position onto the base piece 4, where it locks in place as in the embodiment example described above, it can no longer be released from this position. This is not to be understood as being limiting in this context, because, where it is desired, the locking can be made to be releasable through appropriate tools or the like.

Figure 5A:
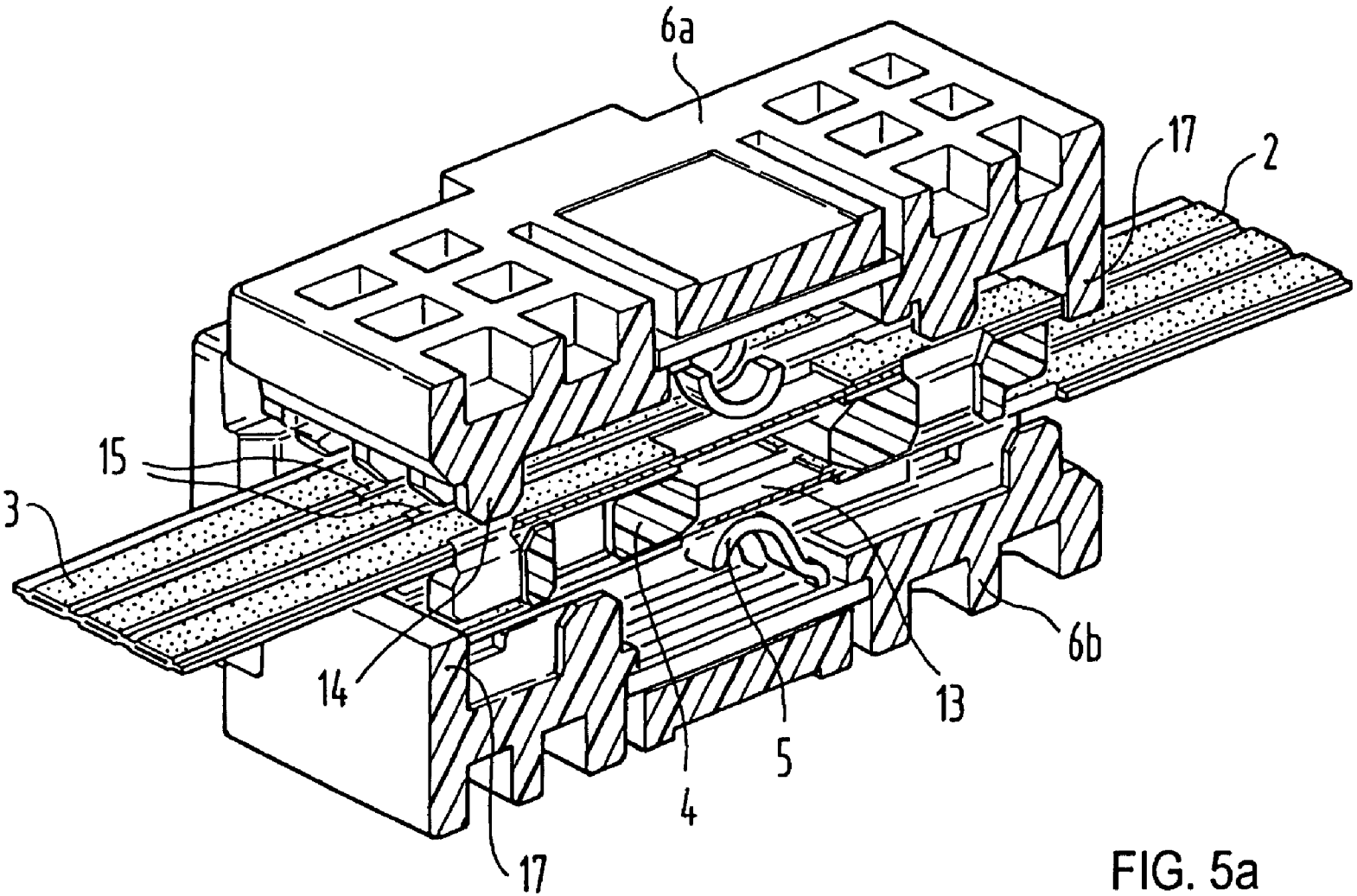
FIG. 5*a* to *c*, a second embodiment of a clamp connector of the invention with ground tap.
Figure 5C:
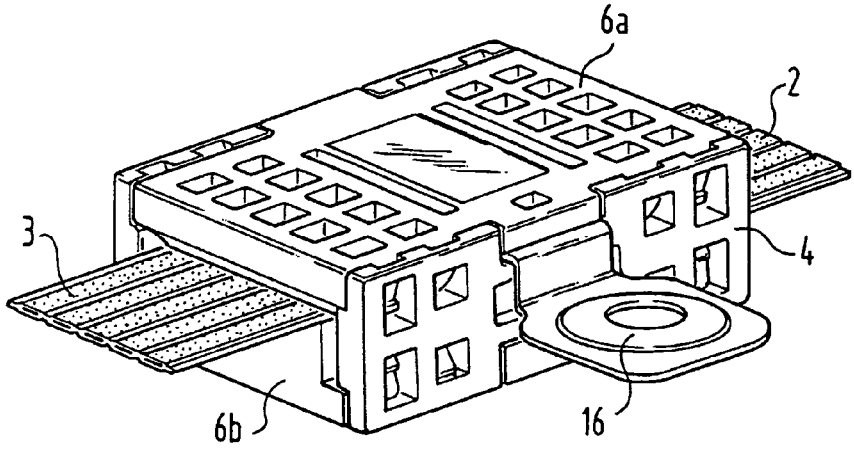
Figure 5B:
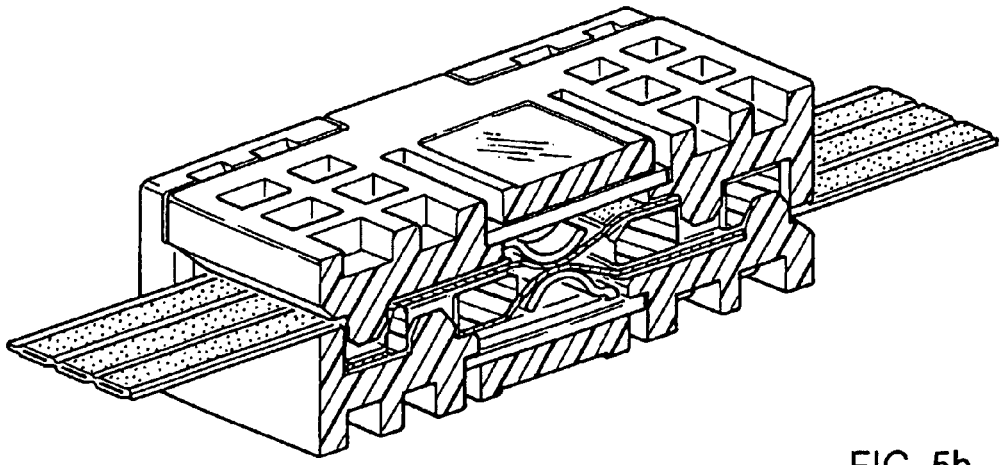

FIGS. 5*a*–*c*show a second embodiment of the clamp connector of the invention. FIG. 5*a*shows a perspective view of the clamp connector in longitudinal section. In contrast to the embodiments described above, this clamp connector has two mating pieces 6*a*, 6*b*, which can be locked on the top side and bottom side of a base piece. The base piece 4 has an opening 13 in its center, through which the bare conductive tracks of the flexible ribbon cables 2, 3 can be brought into contact with one another. This occurs via the spring elements 5, which are each fixed in the mating pieces 6*a*, 6*b*. The strain relief occurs in this embodiment example via lances 14, which dip into the slots 15 provided in the flexible ribbon cables 2, 3. Provided on the two mating pieces 6*a*, 6*b* are terminal stops 17, against which the head ends of the cable abut during insertion of the flexible ribbon cables into the connector in the prelocking position.

FIG. 5*b* shows the connector in locked position. FIG. 5*c* shows that the upper spring element is constructed as a spring contact that protrudes laterally, this lateral protrusion 16 representing a ground tap. For this purpose, the insulation of the conductive tracks of the upper flexible ribbon cable 3 shown in FIG. 5*a* is stripped on both sides. In this way, it is ensured that a contact is produced between the ground tap 16 and both of the conductive tracks of the flexible ribbon cables 3 and 2.

The conductive tracks can consist of metal strips made of a copper alloy or of conductive tracks produced by vapor-deposition, sputtering, or conventional methods used in the manufacture of circuit boards. FIGS. 5*b* and 5*c* show the clamp connectors in locked position.

Figure 6:
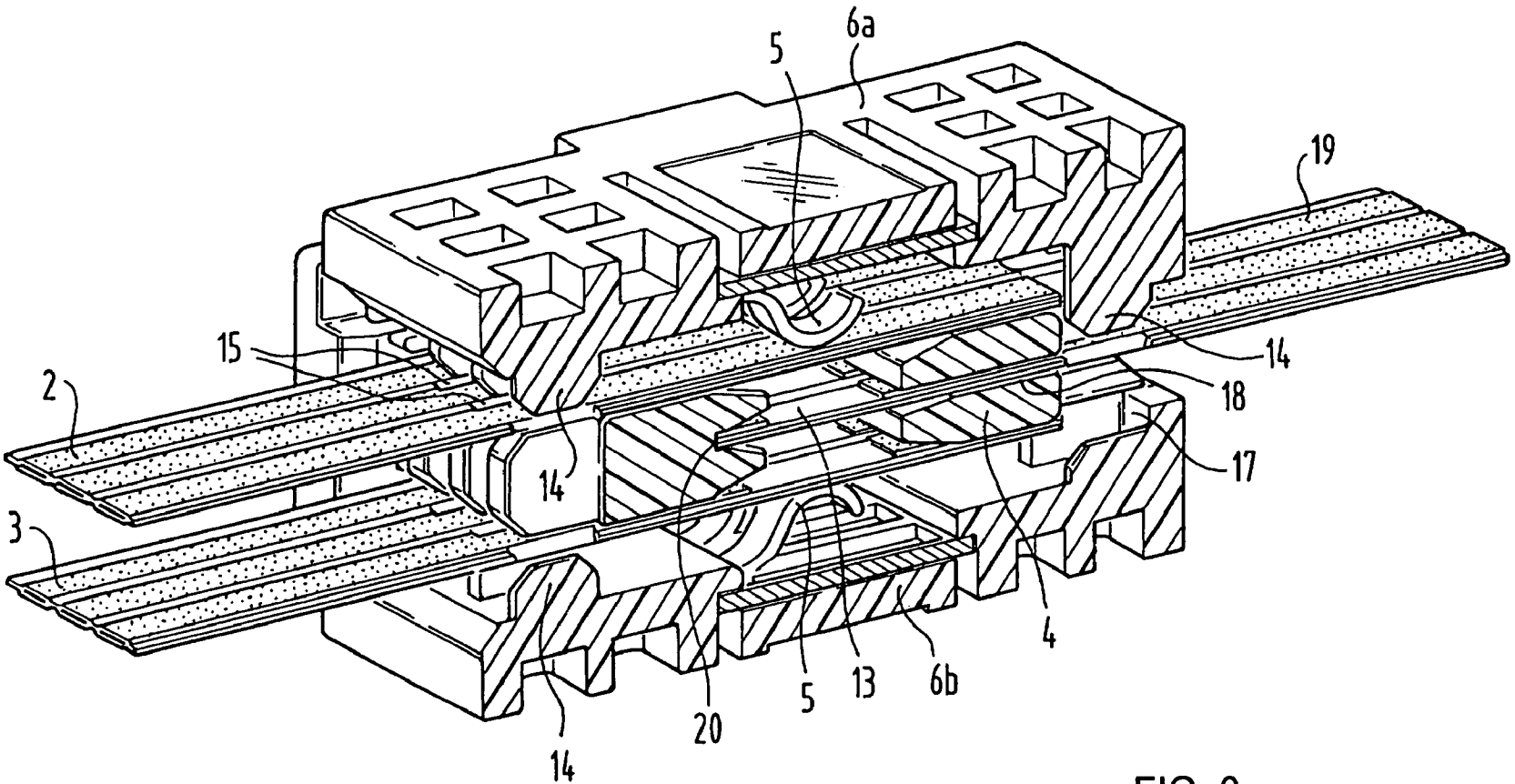
FIG. 6, a third embodiment of a connector of the invention as Y connector.

FIG. 6 shows a third embodiment of a clamp connector of the invention, in which a flexible ribbon cable 19 is connected to two other flexible ribbon cables 2, 3. This embodiment is similar in large part to that in FIG. 5, merely with, essentially, a slot 18 being provided roughly in the meridian plane of the base piece 4, through which the flexible ribbon cable 19 is inserted until its head end has crossed the central opening 13 in the base piece 4 and, finally, has reached its terminal stop in a receiving groove 20 on the opposite-lying edge of the opening 13. The cable 19, just like the cables 2 and 3, is secured by a strain relief 14, 15, such as has been described in connection with FIG. 5.

Figure 7A:
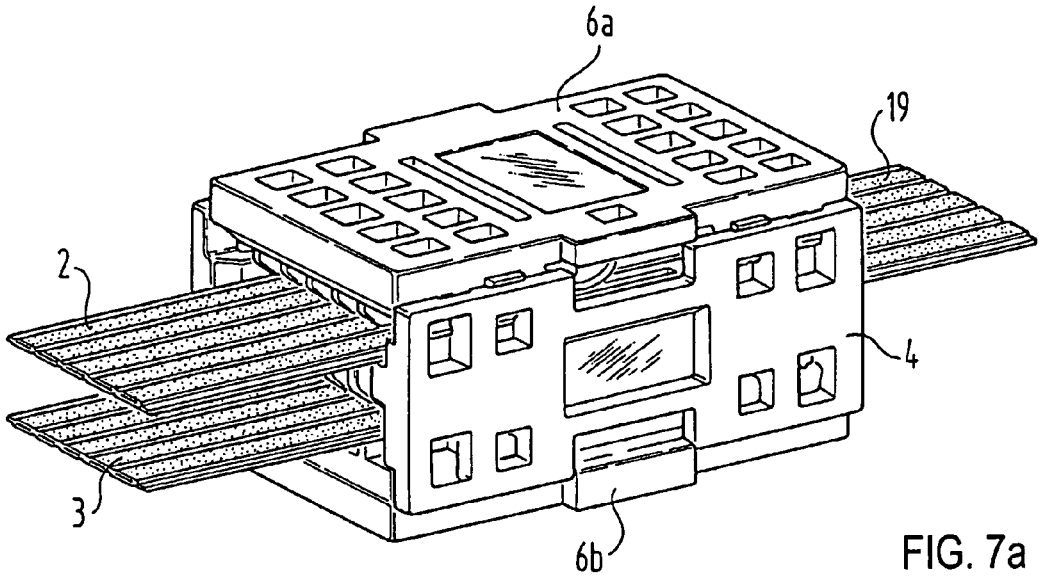
FIG. 7*a* to *d*, the connector according to FIG. 6 in prelocking position and in final locking position in perspective view and internal sectional view.
Figure 7C:
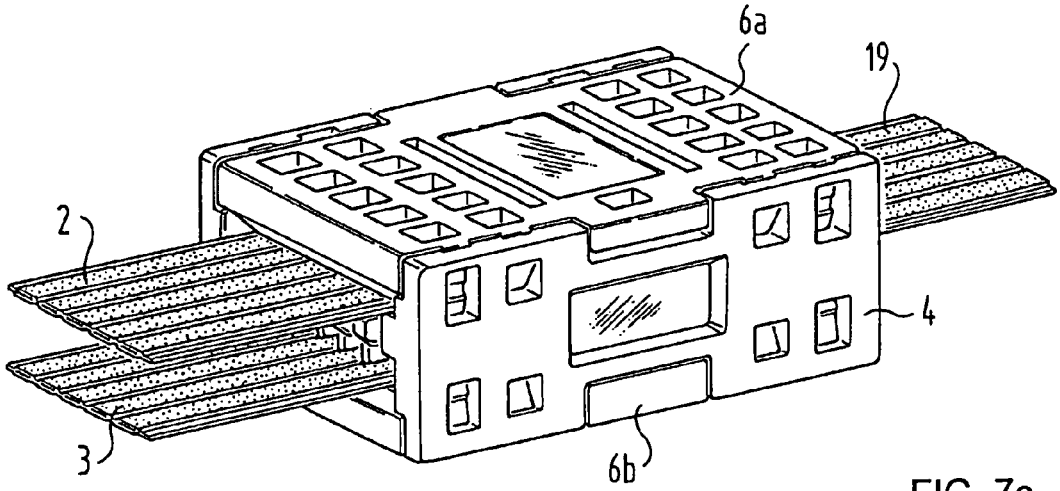
Figure 7B:
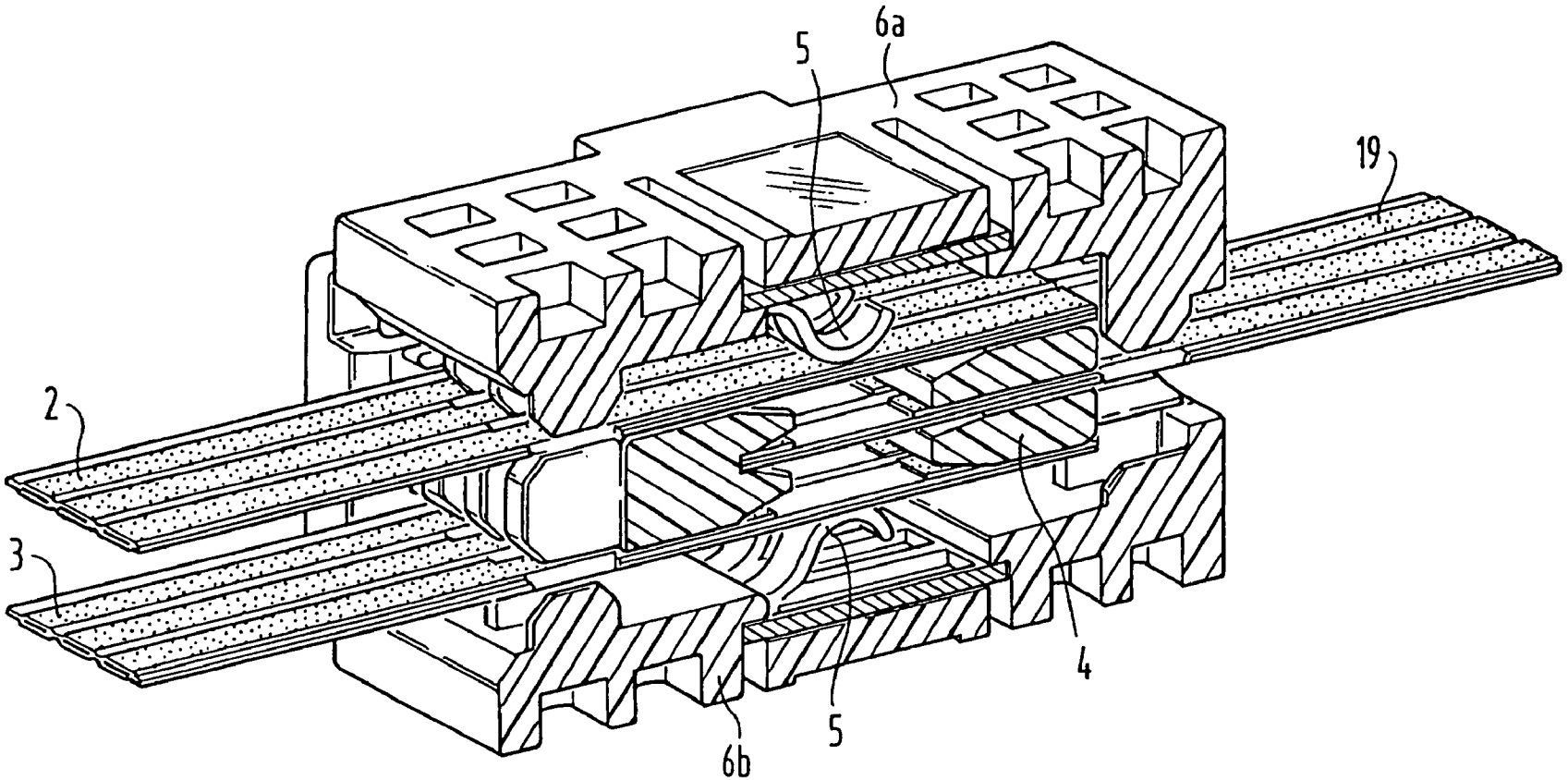
Figure 7D:
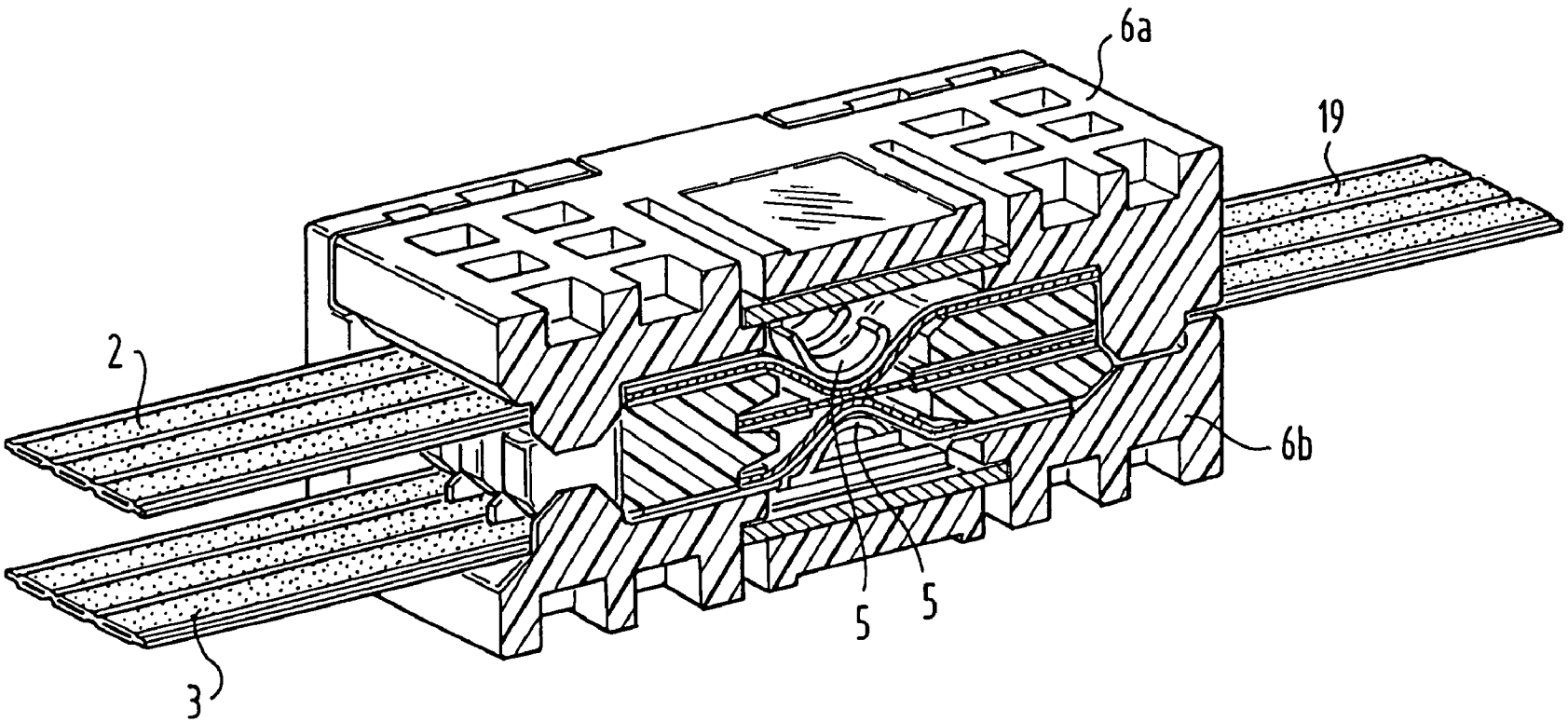

FIGS. 7*a*–*d* show the clamp connector according to FIG. 6 in prelocking position and in final position, once in perspective view and once in longitudinal section. Evident in FIG. 7*a* is the prelocking position, during which the flexible ribbon cables 2, 3, and 19 can be inserted into the connector. In this operation, all cables run up against stops, as already mentioned in connection with FIG. 5. FIG. 7*c* shows the connector in its final position, which, here, too, as in the preceding embodiment examples, is designed to be unreleasable. FIG. 7*d* shows how the spring elements here press all three flexible ribbon cables 2, 3, 19 at one site against one another. For this, a stripping of the insulation of the conductive tracks is performed, as needed, either only on the top side, on the bottom side, or on both sides at the head end of the middle flexible ribbon cable 19.

Figure 8:
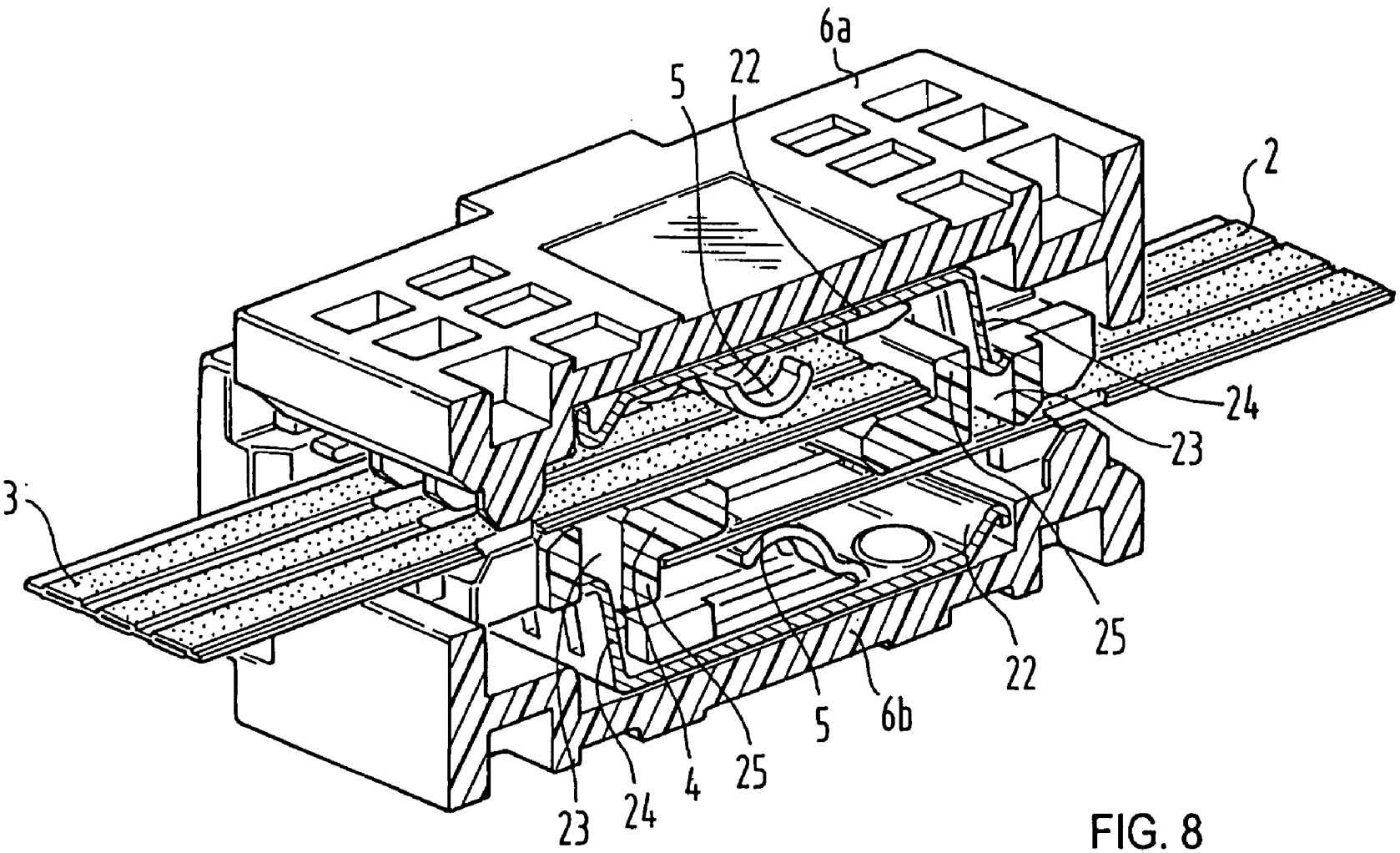
FIG. 8, a fourth embodiment of a clamp connector of the invention with a shielding.
Figure 9A:
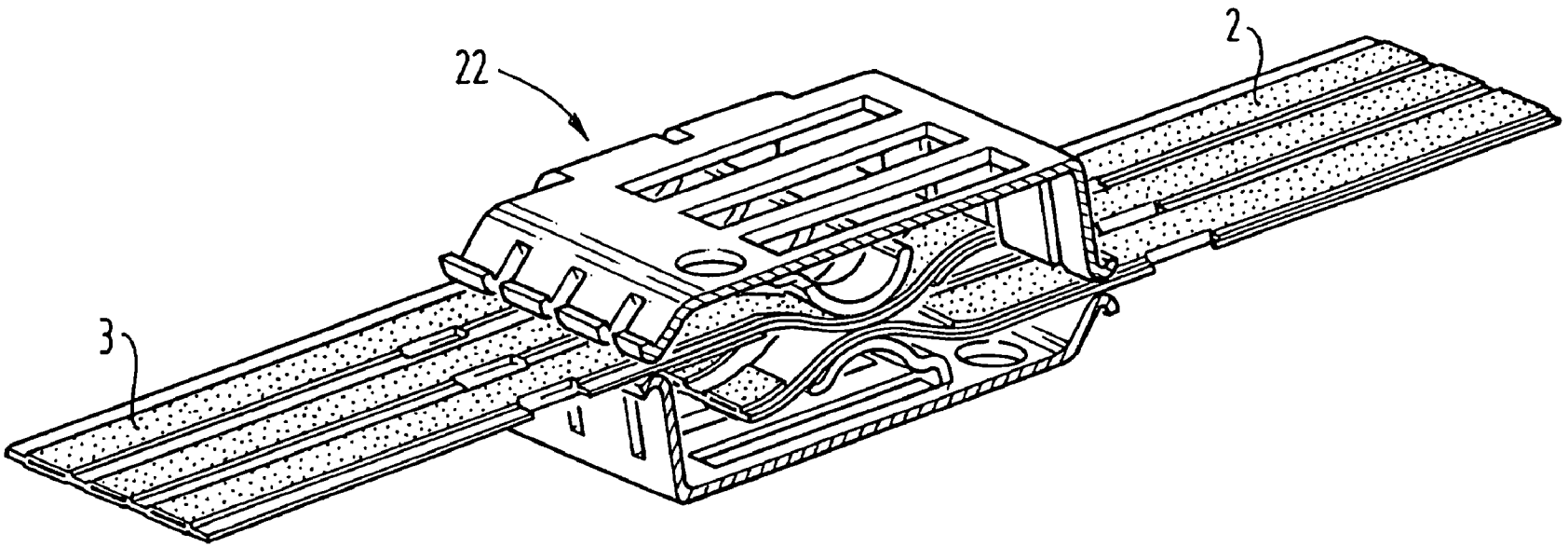
FIG. 9*a* to *c*, the shielding and the clamp connector according to FIG. 8, sectioned in prelocking position and in final locking position.
Figure 9B:
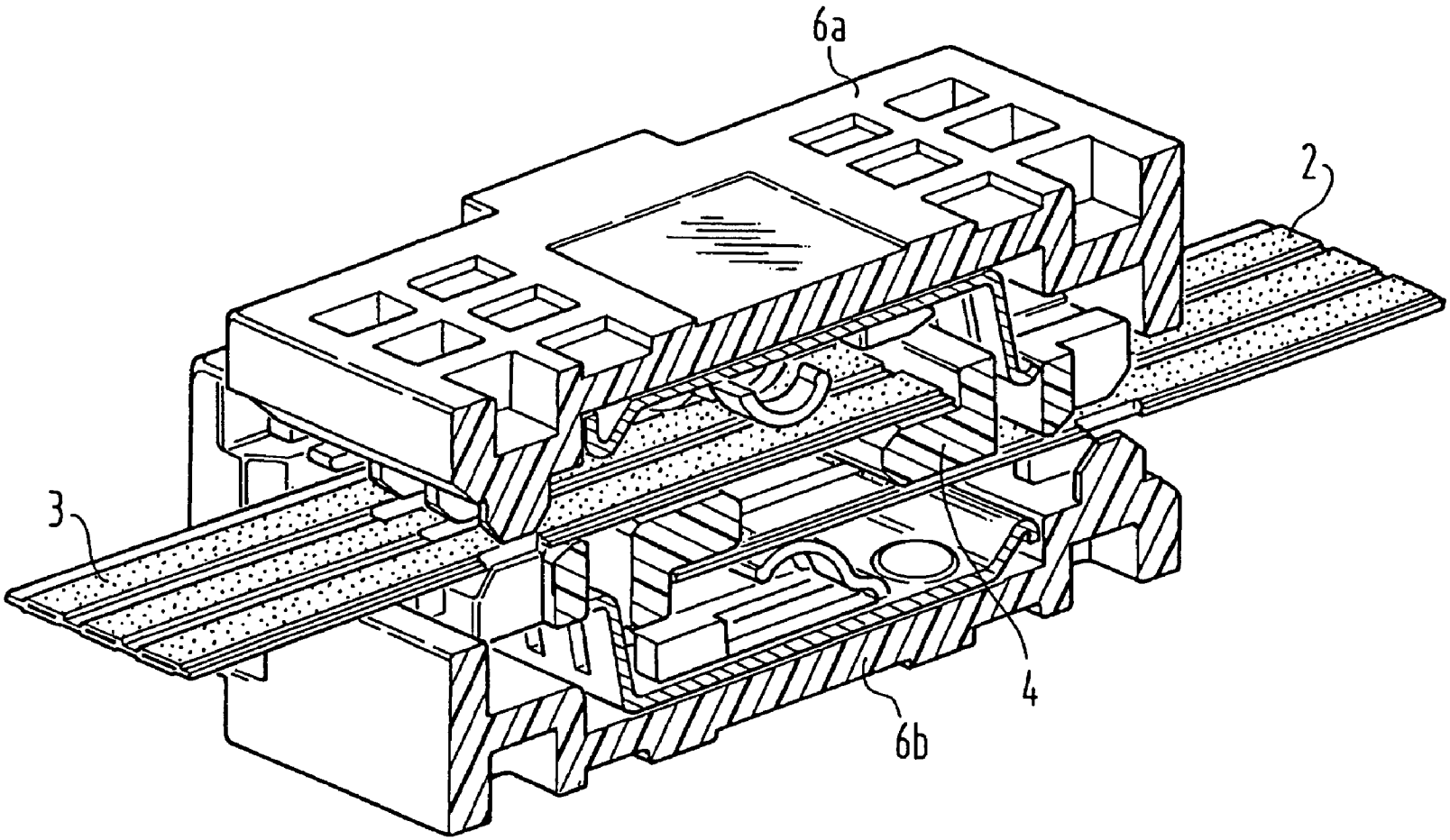
Figure 9C:
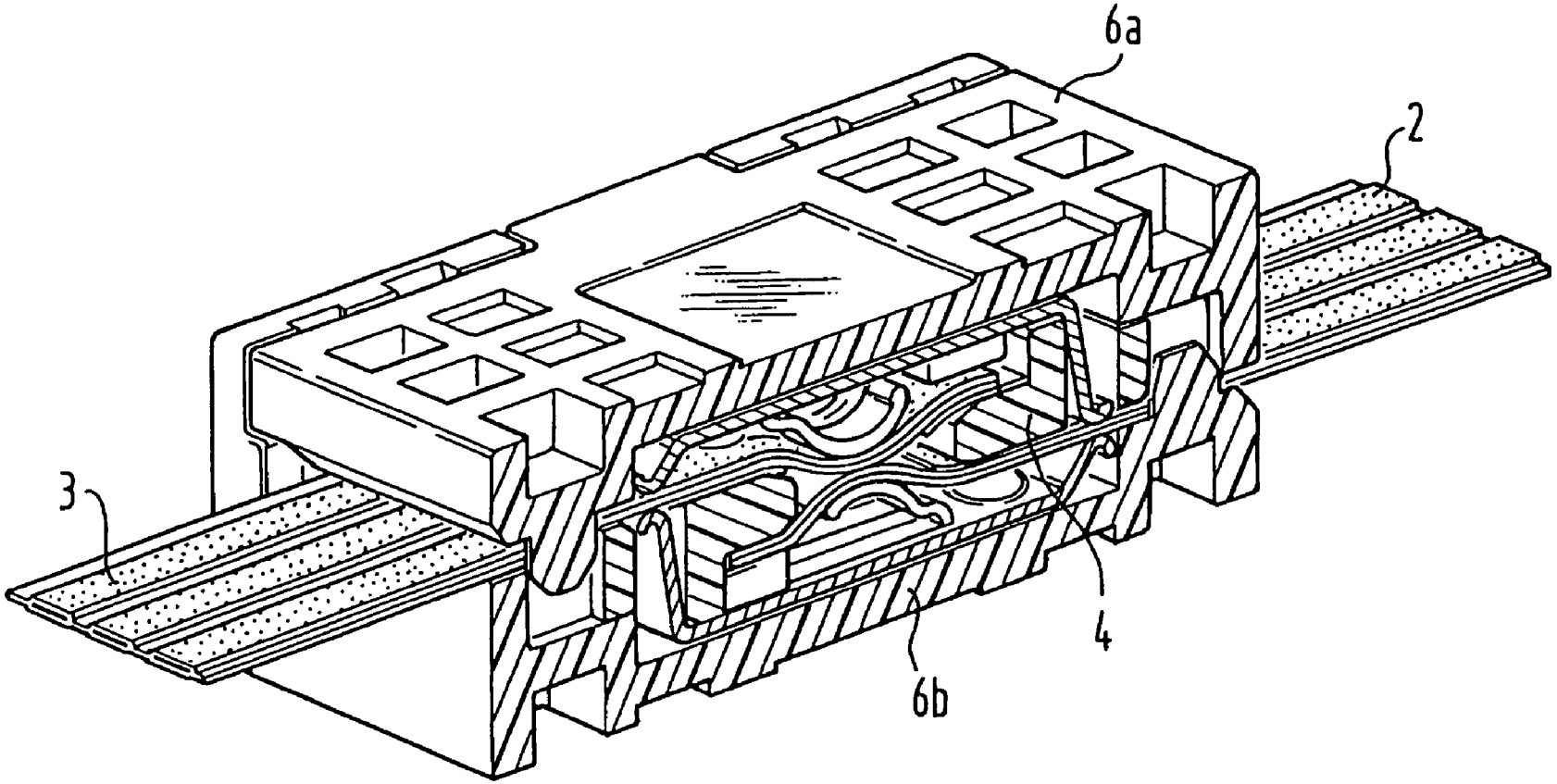

FIGS. 8 and 9 show a fourth embodiment of a clamp connector of the invention, for which a shielding of the contact region between the flexible ribbon cables 2, 3 being connected is provided. For this purpose, the spring elements 5 are constructed in the form of a base plate 22, away from which the springs 5 extend, as in the embodiment example according to FIG. 5. The base plate 22 is bent back at its front and back ends toward the flexible ribbon cables 2, 3[2] in such a way that the bent ends of the two shieldings on the two mating pieces 6*a*, 6*b* lie opposite each other and clamp the respective flexible ribbon cable between them. The ends of the base plate 22 are guided through slots 23 in the base piece 4. Preferably, the ends of the base plate 22 are constructed as elastic spring arms 24. The terminal stops, provided here as well, for the head ends of the flexible ribbon cables 2, 3 are formed on the base piece 4. The terminal stops 25 are located in front of the cross slots 23, through which the elastic spring arms 24 in the base piece are passed.

[2][Transltor's Note]The text repeats a sentence fragment, including the reference numbers 2, 3. This is presumably a typographical error.

FIG. 9 shows a shielding cage by itself and the clamp connector in prelocking position and in final locking position, which, apart from the shielding, do not differ essentially from the embodiment example shown in FIG. 5.

The above-described embodiment examples of the present invention serve only for illustration of the invention defined in the claims and, in this respect, are not to be understood as being limiting.

The invention claimed is:

1. A clamp connector for at least two aligned flexible ribbon cables, comprising a base piece, a spring element for pressing together the surfaces being contacted, and a mating piece, wherein the base piece and the mating piece can be attached to each other in a prelocking position and in a final locking position, characterized in that:

the at least two flexible ribbon cables, with their respective subregions stripped of insulation for contact, are pressed on each other; and the sides of the base piece and of the mating piece facing the flexible ribbon cables being connected have complementary depressions or projecting reliefs, by means of which the flexible ribbon cables are guided for formation of a strain relief, and wherein the spring element has a number of steel springs, fixed in the base piece, corresponding to the number of conductive tracks of the flexible ribbon cables.

2. The clamp connector according to claim 1, further characterized in that the steel springs are centrally fixed strips, the respective two ends of which are spirally wound inward.

3. The clamp connector according to claim 2, further characterized in that the mating piece has a cross rib between the support sites of the steel springs.

4. The clamp connector according to claim 1, further characterized in that the base piece has a bottom plate and two side walls, on which catches are arranged for the prelocking position and the final locking position of the mating piece.

5. The clamp connector according to claim 1, further characterized in that the ribs formed on the base piece and on the mating piece run transverse to the longitudinal direction of the flexible ribbon cables and form terminal stops for the head ends of the flexible ribbon cables being connected.

6. The clamp connector according to claim 1, further characterized in that the base piece has a recess, through which two bare flexible ribbon cables, which are arranged on the top side and the bottom side of the base piece, are pressed against each other by respective spring elements, which are arranged on the mating pieces locked at the top side and the bottom side of the base piece.

7. The clamp connector according to claim 6, further characterized in that the strain relief is formed by lances engaging in slots provided in the respective flexible ribbon cables.

8. The clamp connector according to claim 6, further characterized in that the spring elements or a spring element are (is) constructed as contact springs with lateral protrusion as a ground tap and the flexible ribbon cable(s) is (are) stripped of insulation on both sides.

9. The clamp connector according to claim 6, further characterized in that each of the two mating pieces has a terminal stop shoulder for the head end of the respective flexible ribbon cable.

10. The clamp connector according to claim 6, further characterized in that, for formation of a Y connector, two flexible ribbon cables are inserted on the two sides of the base piece with their head end in the same direction and the base piece has a slot, roughly at the level of its meridian plane between its top side and its bottom side, for inserting a third flexible ribbon cable, the front region of which is stripped of insulation on both sides and which crosses the recess in the base piece and is supported, at the opposite-lying edge of the recess, in a receiving groove, and the spring elements press together all three flexible ribbon cables in the region of the recess.

11. The clamp connector according to claim 6, further characterized in that the third flexible ribbon cable passes out of the base piece at the end thereof, which is placed opposite the end from which the first two flexible ribbon cables project.

12. The clamp connector according to claim 6, further characterized in that the spring elements in each mating piece each originate from a common base plate, which, together with the base plate of the spring element arranged on the other mating piece, forms a closed shielding around the contact site of the flexible ribbon cables.

13. The clamp connector according to claim 12, further characterized in that the base plates of the spring elements rest on the flexible ribbon cables with side walls that pass through cross slots in the base piece and that are provided with elastic spring arms, the side walls of the two base plates being essentially aligned flush with each other.

14. The clamp connector according to claim 11, further characterized in that terminal stops for the flexible ribbon cables are arranged on the base piece on both sides.

15. A clamp connector for connecting at least two flexible ribbon cables, comprising:

a base;

a mating piece, wherein the base and the mating piece are movably attached to each other between a fixed prelocking position and a fixed final locking position; and at least one spring element connected to the base, wherein the at least one spring element is adapted to press conductive surfaces of the ribbon cables together, wherein the at least one spring element has a number of steel springs corresponding to a number of conductive tracks of the flexible ribbon cables.

16. A clamp connector as in claim 15 wherein sides of the base and sides of the mating piece facing the flexible ribbon cables have complementary depressions and projecting reliefs which are adapted to guide the flexible ribbon cables and form at least one strain relief for the ribbon cables.

17. A clamp connector for connecting at least two flexible ribbon cables, comprising:

a base;

a mating piece, wherein the base and the mating piece are connected to each other between a fixed prelocking position and a fixed final locking position; and at least one spring element fixed to the base, wherein the at least one spring element is adapted to press surfaces of the ribbon cables together, and wherein the at least one spring element has steel springs.

18. A clamp connector as in claim 17 wherein sides of the base and sides of the mating piece facing the flexible ribbon cables have complementary depressions and projecting reliefs which are adapted to guide the flexible ribbon cables and form at least one strain relief for the ribbon cables.

* * * * *